US005212939A

United States Patent [19]

Pratt, Jr.

[11] Patent Number: 5,212,939

[45] Date of Patent: May 25, 1993

[54] MARINE MOORING SWIVEL FITTING

[76] Inventor: John M. Pratt, Jr., 113 Whiskers La., Litchfield, Conn. 06759

[21] Appl. No.: 802,234

[22] Filed: Dec. 4, 1991

[51] Int. Cl.[5] ..... F16G 13/12

[52] U.S. Cl. ..... 59/93; 59/86; 59/95; 24/129 R; 114/294; 441/23

[58] Field of Search ..... 59/78, 86, 93, 95; 114/294; 441/21, 23; 24/129 R

[56] References Cited

U.S. PATENT DOCUMENTS

| | | | |
|---|---|---|---|
| 2,067,615 | 1/1937 | Metcalf et al. | 24/129 R |
| 2,538,021 | 1/1951 | Lushbaugh | 24/129 R |
| 3,817,028 | 6/1974 | Blackwood | 59/93 |
| 3,962,811 | 6/1976 | Buschini | 59/86 |
| 4,689,904 | 9/1987 | Briscoe | 59/93 |

FOREIGN PATENT DOCUMENTS

| | | | |
|---|---|---|---|
| 0307255 | 3/1989 | European Pat. Off. | 114/294 |
| 2745859 | 4/1979 | Fed. Rep. of Germany | 59/95 |
| 0292586 | 12/1987 | Japan | 441/23 |

*Primary Examiner*—David Jones
*Attorney, Agent, or Firm*—Dallett Hoopes

[57] ABSTRACT

A marine mooring swivel fitting for connection into a mooring line is a generally dumbbell-shaped element having a relatively slender elongate neck with outward enlargements at the opposite ends of the neck respectively and a mooring line attachment on at least one end of the element. In use the attachment may connect the fitting in the mooring line, the slender elongate neck being adapted laterally to receive swivelly therearound one or more conventional shackles. Such a shackle, depending on whether the swivel is at the upper or lower end of the mooring line, may be secured to a pendant made fast to a marine craft on the surface or secured to an anchoring device. The enlargements, larger than the opening in the shackle, serve to limit the longitudinal movement of the shackle on the element without limiting rotational movement of the shackle around the element.

11 Claims, 2 Drawing Sheets

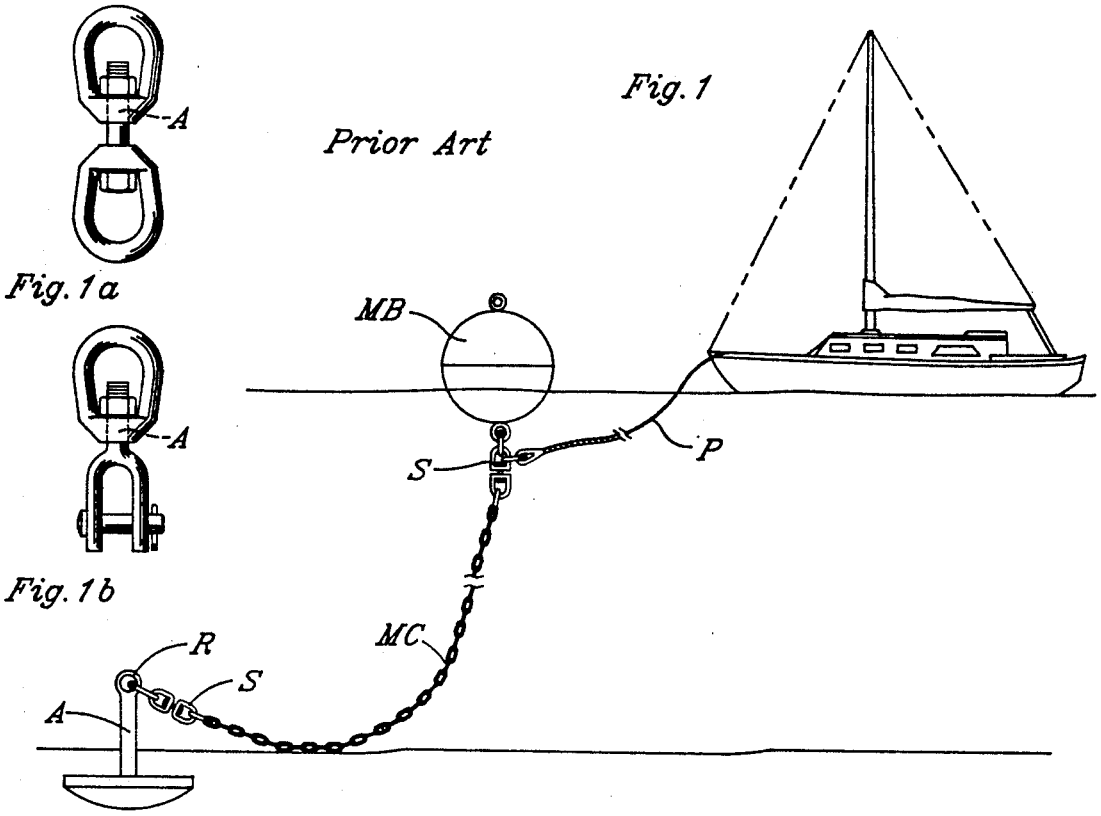
A
Fig. 1a
A
Fig. 1b
Prior Art
Fig. 1
MB
S
P
MC
R
S
A
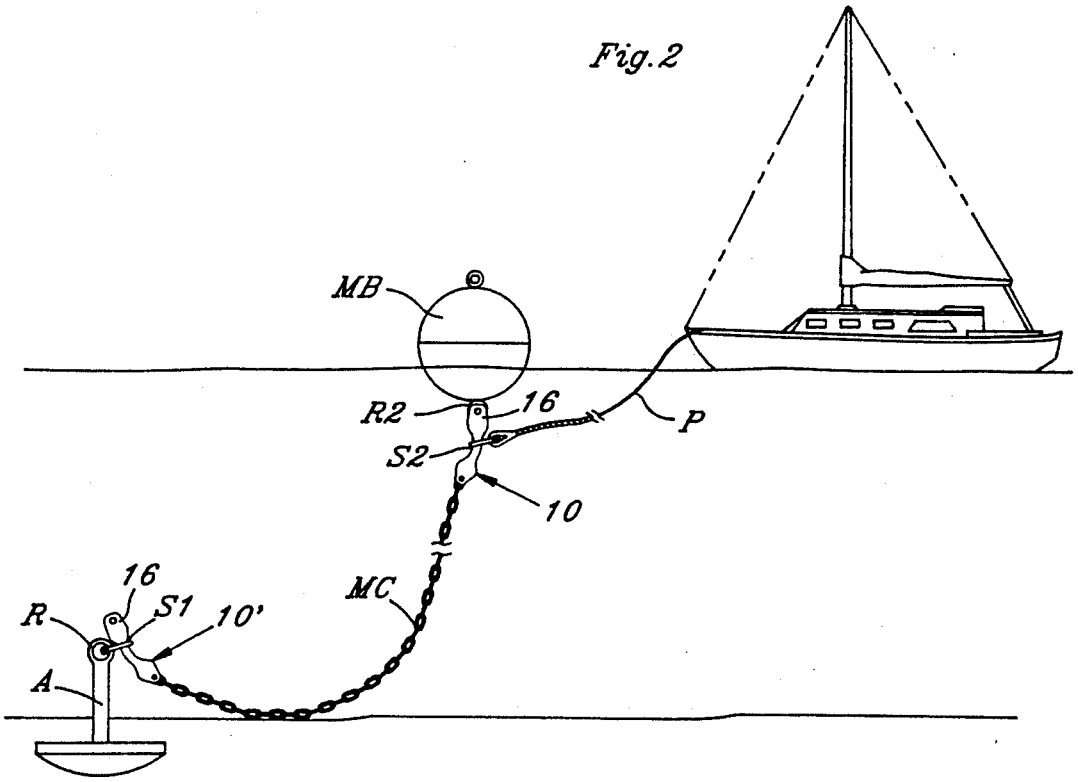
Fig. 2
MB
R2
16
P
S2
10
16
S1
10'
R
MC
A

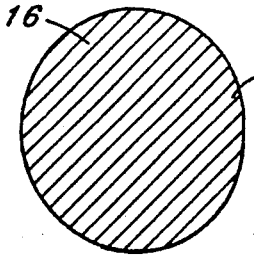
Fig. 5
Fig. 6
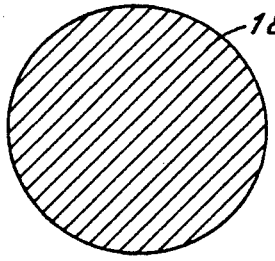
Fig. 7
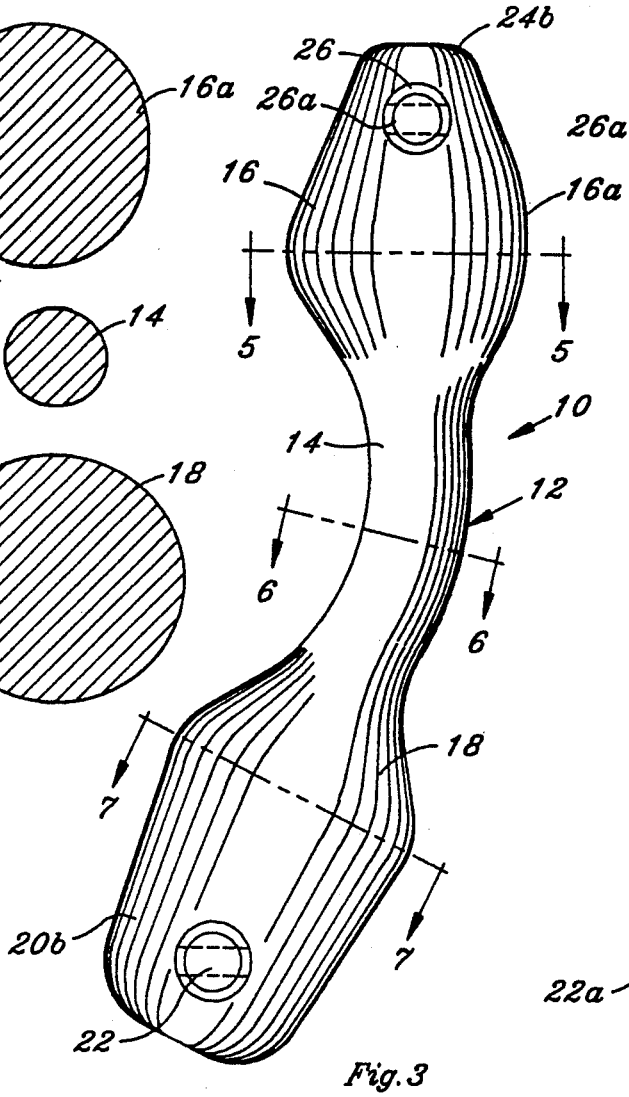
Fig. 3
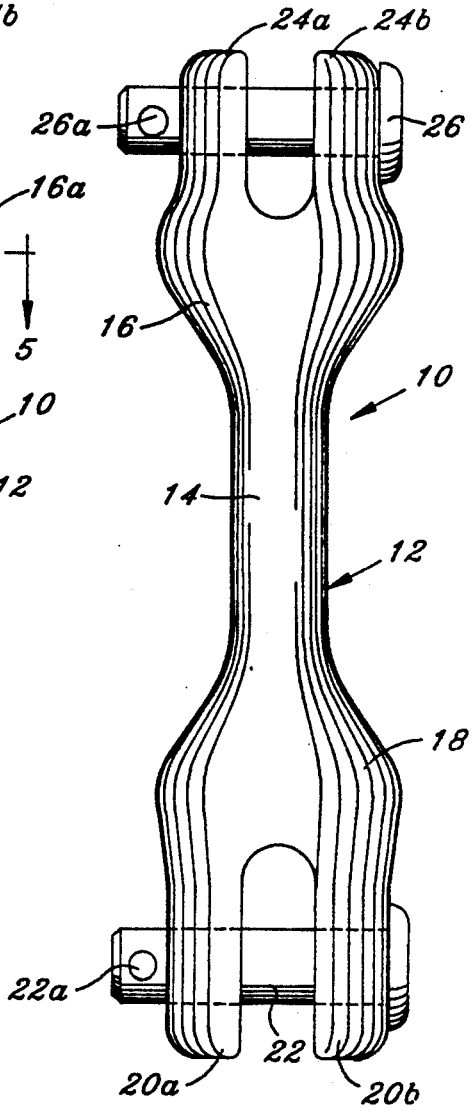
Fig. 4
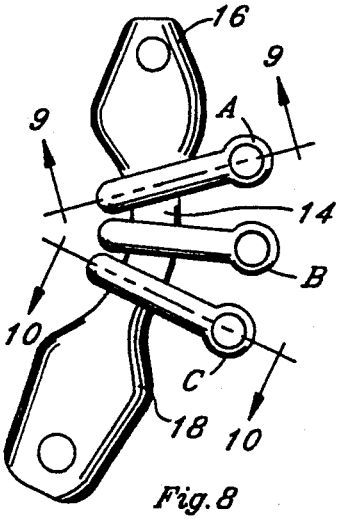
Fig. 8
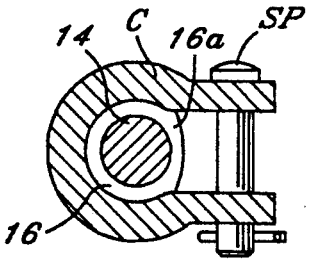
Fig. 9
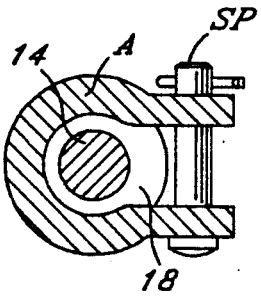
Fig. 10

MARINE MOORING SWIVEL FITTING

BACKGROUND OF THE INVENTION

1. Field of the Invention

This invention relates to a swivel fitting for marine mooring. More specifically, this invention relates to a swivel fitting which is readily protectable from corrosion and, when installed in a mooring line, readily allows swiveling connection to a plurality of mooring pendants or to an anchoring device.

2. Description of Related Art including Information Disclosed under §§1.97 to 1.99

Traditional mooring practice employs various combinations of chain, shackle and swivels to connect by chain the eye of an anchor stock or mooring weight to a bouyant float and then, in turn, to a rope or cable pendant which makes the final attachment to the vessel. The vessel is free to move with wind and current. This movement induces twisting in the mooring chain, substantially decreasing the inherent strength of the chain and causing it to foul itself and reduce scope. In order to minimize these tendencies, moorings usually include one or more swivels to permit rotational movement of the vessel without causing the chain to develop a twist.

Moorings have been assembled (FIG. 1) from a combination of conventional rigging components, all of which have proved quite satisfactory for conventional dry land rigging applications, but readily susceptable to corrosion in marine use. A mooring is only as strong as its proverbial weakest link. Assuming that a mooring is assembled from components that have a similar strength rating —again common practice for reasons of economy—the swivels S are the weak links that most often lead to failure of the mooring. This failure can take one of two modes: either simple fracture failure of the swivel, or corrosion-induced seizing which prevents the intended swiveling action. Both failure modes can be directly traced to identifiable design weaknesses in the standard swivel when it is used in a corrosive marine environment.

Standard marine swivels are identified in FIGS. 1*a* and 1*b*. FIG. 1*a* shows a so-called "eye-and-eye" swivel. It comprises two rings, one above the other, the adjacent sides of the two rings being flattened and thickened and both apertured at A in alignment. A galvanized bolt extends through the two apertures and receives a nut to hold the assembly swivelly together.

FIG. 1*b* shows a so-called "jaw-and-eye" swivel. It comprises an upper ring or "eye" flattened and thickened and apertured like the upper ring in FIG. 1*a*. Completing the "jaw-and-eye" swivel is an inverted "Y"-shaped yoke, the stem of which is threaded and inserted through the aperture A in the "eye" and nutted.

Swivels intended for marine use are usually protected from corrosion by hot dip galvanizing. If the components are dipped prior to assembly, the aperture A in the "eye" is often drilled out to permit the bolt or shank of the jaw to rotate freely. If the swivel is assembled first and then galvanized, very little protective material will penetrate the aperture of the "eye", leaving both the aperture and the bolt or shank of the "jaw" underprotected from corrosion. In any case, the design intrinsicly predetermines that normal service wear will be concentrated within the failure zone, leading to an early erosion of any protective coating and encouraging rapid corrosion.

When a mooring is in continuous use, the accelerated deterioration in the failure zone will soon make the swivel the weakest link in the mooring, leading to a potential fracture failure in the case of heavy storm loading. If a mooring remains unused without a rotational load for sufficient time, the corrosion in the failure zone will cause the swivel to lose its rotational freedom, setting up failure through seizure when put back into service. This failure mode is particularly insidious because it cannot be avoided by simply using a larger, stronger swivel.

The present invention was conceived to avoid the weaknesses inherent in the conventional swivels while incorporating features that are especially suited for mooring applications. The present swivel fitting is designed to be used with one or more standard bow or anchor shackles or a shackle to the ring on the anchor stock. The shape of the present swivel fitting readily accepts hot dip galvanizing to full effect for maximum protection. The failure zone is more massively formed in the present swivel fitting than in conventional swivels, assuring to swivels comprising the present fitting a longer life to failure in a marine environment. Further, the standard shackle loosely encircles the swivel fitting neck so that corrosion cannot easily induce seizing.

SUMMARY OF THE INVENTION

The invention, therefore, is a marine mooring swivel fitting for connection into a mooring line running from a mooring float down to a bottom-engaging anchoring device, the fitting being a unitary element comprising:

(a) a generally dumbbell-shaped element having a relatively slender elongate neck with outward enlargements at the opposite ends of the neck respectively and (b) longitudinally extending mooring line attaching means on at least one end of the element, whereby the attaching means may be used to connect the fitting to the mooring line, the slender elongate neck being adapted to receive swivelly therearound one or more conventional shackles secured to pendants made fast to a marine craft on the surface, or to the anchoring device depending on the position of the fitting in the mooring line as will be understood, and the enlargements serve as upper and lower stops for the travel of said one or more shackles on the element.

BRIEF DESCRIPTION OF THE DRAWINGS

Other features and objects of the invention will be understood from the following specification, including the drawings, all of which relate to a non-limiting embodiment of the invention. In the drawings:

FIG. 1 is an elevational view showing in a larger scale a mooring system as used in the prior art and in lesser scale a sailboat moored thereby;

FIGS. 1*a* and 1*b* are conventional swivels as described above;

FIG. 2 is a view similar to FIG. 1 but showing a mooring system using two of the fittings embodying the invention;

FIG. 3 is a greatly enlarged side elevational view of a fitting embodying the invention;

FIG. 4 is front elevational view of a fitting including attaching pins;

FIG. 5 is a sectional view taken on the line 5—5 of FIG. 3;

FIG. 6 is a sectional view taken on the line 6—6 of FIG. 3;

FIG. 7 is a sectional view taken on the line 7—7 of FIG. 3;

FIG. 8 is a reduced view showing a plurality of shackles installed around a fitting embodying the invention to make a swivel;

FIG. 9 is a sectional view taken on the line 9—9 of FIG. 8; and

FIG. 10 is a sectional view taken on the line 10—10 of FIG. 8.

DESCRIPTION OF THE PREFERRED EMBODIMENT

A mooring system embodying two of the fittings of the invention is shown in FIG. 2, the fittings being designated 10 and 10'. The system comprises an anchoring device A, such as a mushroom anchor or heavy weight, having ring R at the upper end of its stock. A standard shackle S1 is looped through the ring R and around the neck of the first fitting 10'. A mooring chain MC, or line, is attached to and runs from the fitting 10' up to a second fitting 10. The chain is attached to the fittings in a way to be described. The upper end of the fitting 10 is attached to a ring R2 at the lower end of a mooring ball MB.

A second shackle S2 surrounds the neck of the fitting 10 as will be described and a mooring pendant P, which is formed with an eye, is secured by the pin of shackle S2. The upper end of the pendant is, of course, secured to the vessel shown.

Referring now to FIG. 3, the fitting 10, which is identical to the fitting 10 and 10' in FIG. 2, and which embodies the invention, is shown in side view. It is a unitary metal element preferably forged of a strong steel alloy. It comprises a dumbbell-shaped structure 12 including an elongate neck 14 which, as shown, is preferably curved better to distribute the load along a generally straight line as will appear.

At either end of the elongate neck 14 there is an enlargement 16, 18. The upper or load enlargement 16, against which a shackle will pull under load, is preferably non-symmetrical, being faired off at 16*a* to avoid rubbing against a line which may be attached to a shackle. The lower enlargement 18 is preferably symmetrical. Enlargements are smooth and bulbous in shape to avoid "catching" on things and to receive better the proper coatings of corrosion protective metal.

As shown in FIG. 8, the neck 14 is adapted to receive a plurality of shackles designated A, B and C in FIG. 8. As shown in FIG. 9, the neck 14 is made slender enough to be received through the throat T of a conventional shackle. Once the shackles are installed on the neck 14 and their pins secured as shown by cotter pins, the shackles are limited to travel between the upper or load enlargement 16 and the lower enlargement 18 which serve as stops for the travel of all shackles. The openings in the shackles are not big enough to pass the enlargements 16, 18. In other words, The neck 14 is sized so that it will pass laterally through the throat opening of the shackle and, once the shackle is properly installed, because the enlargements 16 and 18 will not permit longitudinal passage of the opening in the shackle, the shackle is trapped between the enlargements of the element.

As illustrated in FIG. 2, the eye of a pendant P may be installed on any shackle A, B or C, usually by having the eye receive the shackle pin SP (FIGS. 9, 10). In some installations, of course, the pendant is a rope which has a metal guard inside the eye to avoid chafing.

As shown in FIG. 3, the lower end of the dumbbell-shaped element is formed integrally with enlargement 18 with a unitary yoke which comprises two parallel legs 20*a* and 20*b* and which are apertured in alignment to receive a pin 22. Inbetween the legs the terminal link of the mooring chain MC fits to secure the fitting to the mooring chain. This is the case in either the 10 or 10' environment (FIG. 2). A cotter pin (not shown) may be installed in the bore 22*a*.

At the upper end of the element 12 and integral with the load enlargement there is provided a yoke comprising two legs 24 similar to the legs at the lower end of the fitting although they may be less substantial in view of the fact that they do not under normal circumstances bear a substantial load. As shown in FIG. 2, the legs 24*a* and 24*b* may receive the ring R2 at the lower end of the mooring buoy MB. A pin 26 extends through the legs 24*a* and 24*b* and the ring RS and may be secured with a cotter pin through the bore 26*a*. Alternatively, for a lower swivel, a length of chain may extend from the ring R2 on the mooring buoy MB and have its lower ring secured between the legs 24*a* and 24*b*.

Returning to FIG. 8, the plurality of shackles A, B and C can each be connected to a separate pendant leading to the vessel for additional security as if a storm is expected or, in everyday mooring if desired. Under heavy load, as in heavy current or high winds, the vessel will pull hard in a direction away from the anchor and the shackle A at the top of the stack (FIG. 8) of shackles will pull to abut the upper or load enlargement 16 of the fitting. The other shackles will forcefully stack against shackle A.

Similarly, near the anchor, when the chain MC is under load, the fitting 10' will pull against the shackle which will abut the load enlargement 16. Because of the bend in the neck 14 and the shape of the enlargement 16, the tension produced by the load will pass through the fitting F with less stress on the enlargement than would be the case were the enlargement 16 simply an annular flange on a straight neck 14. At the same time, because the enlargement 16 is faired off on the right side, there is little opportunity for the pendant to chafe against the fitting.

It should be understood that in slack conditions, a single shackle or the stack of shackles A, B and C will simply drop to the lower end of the neck and be supported by the large enlargement 18 as a stop, the fitting being supported all the while by the mooring ball MB. Because the neck 14 is substantially less in diameter than the opening in the shackle, shackles are free to rotate and swivel about the neck 14. Thus, as the vessel swings as the wind changes and the current shifts, the pendant and shackles can turn about the fitting.

Similarly in the use of the fitting 10' (FIG. 2) on the shackle at the anchoring device, the fitting is free to turn inside the shackle 51 as the vessel swings. This will avoid the fouling of the mooring chain and the winding up of the chain about the anchor shank.

As stated, the present fitting provides readily available surfaces for the application of anti-corrosive coatings, such as hot dip galvanizing. No parts of the fitting are such that such protective coating cannot be applied. At the same time, and in contrast to conventional mooring swivels, the present fitting can accommodate a large number of shackles.

Variations of the invention are contemplated. For instance, the neck 14 could be made longer to accommodate a larger number of shackles, and for the attachment means, instead of the legs 20*a* and 20*b*, 24*a* and 24*b* simple rings could be forged into the one-piece fitting at either end to achieve the same purpose. The arrangement shown is strongly preferred for many reasons.

Variations in the embodiment disclosed are thus possible without departing from the spirit of the invention. Hence, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. A marine mooring swivel comprising:

(a) a unitary fitting including a generally linear dumbbell shaped body having a relatively slender neck with outward enlargements at either end of the neck, and attaching means extending longitudinally at least one end of the fitting, and (b) a conventional shackle received laterally on the neck, the enlargements being sized not to pass the shackle endwise of the fitting.

2. A marine mooring swivel as claimed in claim 1 wherein attaching means are on the opposite ends of the fitting and they are each integral yokes having each parallel longitudinal legs, apertured in alignment to receive securing pins.

3. A marine mooring swivel as claimed in claim 1 wherein the neck is curved.

4. A marine mooring swivel as claimed in claim 3 wherein the enlargement at one end of the element is reduced on the outside of the curve.

5. A marine mooring fitting for a mooring line comprising a unitary metal body comprising:

(a) a generally linear dumbbell-shaped element having a relatively slender elongate neck with outward bulbous enlargements at the opposite ends of the neck respectively and (b) a longitudinally extending yoke on at least one end of the element integral with one of the enlargements, the yoke comprising a pair of spaced parallel longitudinal legs, the legs being transversely apertured in alignment to receive a securing pin to connect the fitting to the mooring line, whereby the neck is adapted to laterally receive a shackle for swiveling movement on the neck and the enlargements being sized not to permit endwise passage of the opening of said shackle.

6. A marine mooring fitting as claimed in claim 5 wherein the neck is curved and one of the enlargements is faired away on its side more remote from the center of the curve.

7. A marine mooring fitting as claimed in claim 6 wherein the yoke on the enlargement, other than the enlargement which is reduced, is more substantial than the yoke on the reduced enlargement.

8. A marine mooring fitting as claimed in claim 5 wherein a yoke is integrally disposed at either end of the fitting.

9. A marine mooring fitting for connection into a mooring line running from a mooring float down to a bottom-engaging anchoring device, the fitting being a unitary element comprising:

(a) a generally linear dumbbell-shaped element having a relatively slender elongate neck with outward bulbous enlargements at the opposite ends of the neck respectively and (b) outward longitudinally extending yokes on the opposite ends of the element respectively, the yokes each comprising a pair of spaced parallel legs, the legs of each pair being transversely apertured in alignment, whereby securing pins may be extended removably through the apertures in the pairs of legs respectively to connect the fitting into the mooring line, the slender elongate neck being adapted to receive swivelly therearound one or more conventional shackles secured to pendants respectively made fast to a marine craft on the surface, and the enlargements serve as upper and lower stops for the travel of said one or more shackles on the element.

10. A marine mooring fitting as claimed in claim 9 wherein the neck is curved and one of the enlargements is reduced on the outside of the curve.

11. A marine mooring fitting as claimed in claim 10 wherein the yoke on the reduced enlargement is less substantial than the yoke on the enlargement which is not reduced.

* * * * *